United States Patent [19]

Huss

[11] Patent Number: 4,571,059

[45] Date of Patent: Feb. 18, 1986

[54] APPARATUS FOR TRANSFERRING IMAGES OF CONDUCTIVE TONER POWDER

[75] Inventor: Charles P. Huss, Stillwater, Minn.

[73] Assignee: Minnesota Mining and Manufacturing Company, St. Paul, Minn.

[21] Appl. No.: 542,887

[22] Filed: Oct. 17, 1983

[51] Int. Cl.[4] ..... G03G 15/16

[52] U.S. Cl. ..... 355/3 TR; 355/3 R; 355/14 TR

[58] Field of Search ..... 355/3 TE, 3 DD, 14 D, 355/3 TR, 14 TR, 3 R

[56] References Cited

U.S. PATENT DOCUMENTS

| | | | |
|---|---|---|---|
| 3,932,035 | 1/1976 | Sato et al. | 355/3 TR |
| 4,175,265 | 11/1979 | Nelson et al. | 346/74.1 |
| 4,187,774 | 2/1980 | Iwasa et al. | 355/3 TR X |
| 4,207,101 | 6/1980 | Vola et al. | 355/3 TR X |
| 4,338,017 | 7/1982 | Nishikawa | 355/3 TR |
| 4,348,098 | 9/1982 | Koizumi | 355/3 TR |
| 4,373,016 | 2/1983 | Kings et al. | 430/126 |
| 4,401,383 | 8/1983 | Suzuki et al. | 355/3 TR |

*Primary Examiner*—A. C. Prescott

*Attorney, Agent, or Firm*—Donald M. Sell; James A. Smith; Robert L. Marben

[57] ABSTRACT

Apparatus for transferring images of conductive toner powder from a layer carried by a rotatable, electrically conductive member to a dielectric material carried by a rotatable, electrically conductive, cylindrical member. A d.c. voltage supply is connected between the two conductive members and the two members are positioned so the layer on the one and the dielectric material on the other are separated by a slight air space.

2 Claims, 1 Drawing Figure

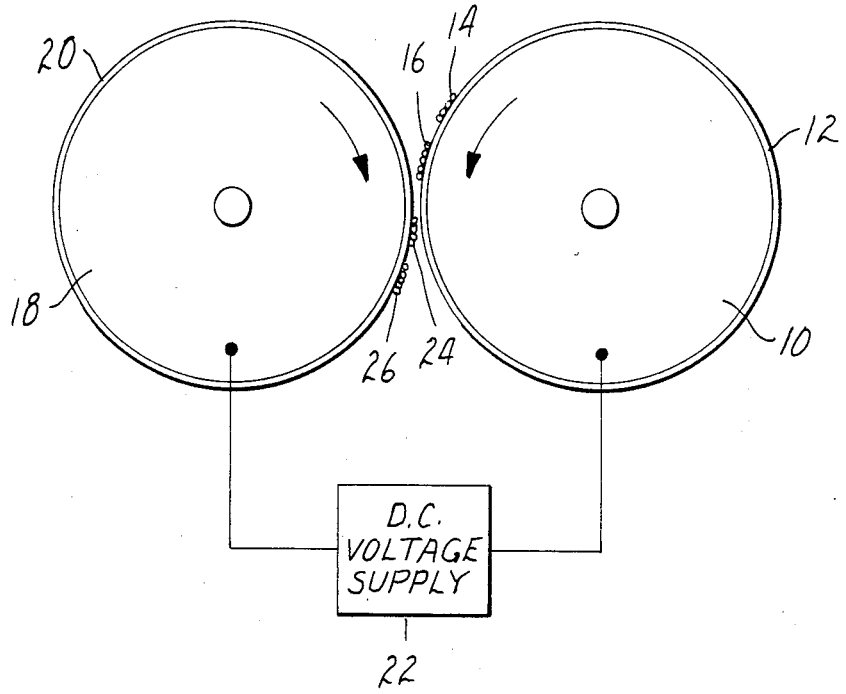
20
16
14
12
18
26
24
10
D.C.
VOLTAGE
SUPPLY
22

APPARATUS FOR TRANSFERRING IMAGES OF CONDUCTIVE TONER POWDER

BACKGROUND OF THE INVENTION

1. Field of the Invention

The invention presented herein relates to apparatus for transferring images of electronically conductive toner powder from the surface of a member to the surface of another member.

2. Description of the Prior Art

In recent years electrostatic copy machines have been developed which employ a developing powder that is carrierless in that no carrier particles are included and only electronically conductive toner powder is used to develop an electrostatic image. Such powders are also used in styli printing apparatus. While there are advantages to the use of electronically conductive toner powder for the forming of images, problems are presented with respect to the transfer by electrical means of such images to another surface. In the case of transfer to plain paper, it is proposed that the paper be pre-dried since the quality of the transfer has been found to be dependent upon the moisture content of the paper. Another approach to avoid the conductivity problem presented by humidity variations in the copy paper involves treatment of the paper to provide a resin coating on a surface of the paper to present a surface that is lower in conductivity. Another approach is to position the image bearing support so it contacts the support to which the toner image is to be transferred and use a dielectric liquid to wet the support on which the powder image is to be transferred with the transfer being aided by a high d.c. voltage that is maintained between the image bearing support and the support to which the toner image is to be transferred. This approach complicates the apparatus in that a mechanism must be used for applying the liquid. In addition, the apparatus must provide for the drying of the copy support to remove the dielectric liquid after the transfer has been made. Odor can also be a problem.

SUMMARY OF THE INVENTION

The invention presented herein provides a solution to the above toner image transfer problem while keeping the apparatus uncomplicated and retaining the advantages involved in the use of a developer of only electronically conductive toner powder. The invention is embodied in a toner powder image transfer apparatus for transferring images of electronically conductive toner powder from the surface of a layer carried on the outer surface of a rotatable, electrically conductive member that includes a rotatable, electrically conductive, cylindrical member having a dielectric material at its outer surface for receiving the transferred toner image with the cylindrical member slightly spaced from the first-mentioned member to provide an air space between the dielectric material at the cylindrical member and the image bearing layer of the first-mentioned member. The axis of rotation of the cylindrical member is positioned parallel to the axis of rotation of the first-mentioned member and a means is provided for applying a d.c. voltage potential continuously between the first-mentioned member and the cylindrical member for transferring toner powder from the layer of the first-mentioned member to the dielectric material at the cylindrical member during rotation of the first-mentioned member and the cylindrical member.

With this arrangement the use of a dielectric liquid is avoided, the quality of the toner image that is transferred is excellent and is maintained with minimal sensitivity to ambient humidity. In addition, no physical contact occurs between the member on which the image is formed and the dielectric material at the cylindrical member to which the image is transferred. Further, the apparatus is suitable for continuous transfer of electronically conductive toner images from a member having a photoconductive layer or a dielectric layer carried on its outer surface with the transfer occurring at a narrow region since the material to which the toner image is transferred is carried by a cylindrical member.

BRIEF DESCRIPTION OF THE DRAWING

The novel features and advantages of the invention presented herein will become more apparent to those skilled in the art upon consideration of the following detailed description which refers to the single figure of the drawing which is a schematic showing of apparatus embodying the invention.

DETAILED DESCRIPTION

Referring to the single figure of the drawing, the apparatus embodying the invention includes a rotatable, electrically conductive member 10, shown as a cylindrical member, which carries a layer 12 of material at its outer surface on which a toner powder image of electronically conductive toner powder is carried. The manner in which the toner image is formed on the layer 12 is not a part of the present invention. Apparatus and processes for providing such a toner image are well known. Thus, the layer 12 can be a photoconductor at which an image is formed by well known electrostatic processes such as that described in U.S. Pat. No. 3,909,258 to Arthur R. Kotz which employs electronically conductive toner powder. The layer 12 can also be anodized aluminum when the member 10 is formed from aluminum and at which an electronically conductive toner image can be formed by use of the electrographic recording process described in U.S. Pat. No. 3,816,840 to Arthur R. Kotz which employs electronically conductive toner powder. The areas 14 and 16 shown at the outer surface of the layer 12 depict toner forming the image carried at the outer surface of the layer 12. The apparatus of the invention also includes a rotatable, electrically conductive, cylindrical member 18 that has a dielectric material at 20 at the outer surface of the cylindrical member 18. The material 20, for example, as in the case of the layer 12 can be anodized aluminum, elastomeric silicone rubber or fluorinated polymers, such as polytetrafluoroethylene and the like. As in the case of the examples given, the material 20 should be one that has the characteristics of a dielectric and should have good release characteristics with respect to the toner powder used to provide the toner images. The cylindrical member 18 is positioned so that the material 20 is spaced slightly from the outer surface of the layer 12 of the member 10. The axis of rotation of the cylindrical member 18 is positioned so that it is parallel to the axis of rotation of the member 10. The member 10 and cylindrical member 18 are rotated in opposite directions so that the layer 12 and material 20 move in the same direction at the air gap presented between the member 10 and the cylindrical member 18. In addition, the member 10 and the cylindrical member 18 are arranged to be moved so the surface speed of the layer 12 and the material 20 at the air gap are equal. A d.c. voltage supply 22 is connected between the conductive member 10 and the conductive member 18 to establish an electric field between the outer surface of layer 12 of member 10 and the outer surface of the material 20 of member 18. Since the member 18 is cylindrical in shape, the electric field to which the toner image, such as at 14 and 16, is subjected to as it enters the air gap will increase until the electric field is sufficient to cause the toner 14 and 16 to move from the layer 12 to the outer surface of the material 20 on member 18. The areas of toner 24 and 26 at the surface of the material 20 depict toner which has been transferred from the layer 12 to the material 20 at the outer surface of member 18. It should be appreciated that in any copy machine or printer utilizing the transfer apparatus as described, the toner image that is transferred to the material 20 on member 18 will be transferred to the final receptor member such as paper. Such transfer can, for example, be accomplished by heat or by pressure or a combination of the two. If heat is to be used, a heat source can be mounted within the cylindrical member 18.

As has been mentioned in the foregoing description, the toner transfer apparatus embodying the invention presented herein can be used as a part of a styli printing apparatus wherein the toner image is formed at the surface of layer 12 in accordance with the process described in U.S. Pat. No. 3,816,840 to Arthur R. Kotz. In such an arrangement the layer 12 for member 10 can be silane epoxy, polyester, polycarbonate or anodized aluminum with the thickness of such coatings being 1 to 15 microns. The cylindrical member 18 can be formed from aluminum and provided with an elastomeric silicone rubber (polymer) over anodized aluminum for the material 20 wherein the anodized aluminum is about 10 microns thick and the silicone rubber has a thickness not in excess of about 65 microns. Air gaps should be at least as large as the extreme dimension of the largest toner particles employed and preferably from about 20 to 175 microns between the layer 12 and the material 20 can be used with a 50 micron gap preferred. The d.c. voltage supply 22 is arranged to provide a voltage from about 300 to 1200 volts with about 500 volts providing optimum operation. The toner powder used in such an arrangement is electrically conductive and can have a conductivity of about $10^{-1}$ to $10^{-7}$ mhos/cm with a conductivity of about $10^{-4}$ mhos/cm preferred. Using anodized aluminum or a steel member 18 with a coating for the material 20 of about 5 to 76 microns of polytetrafluoroethylene is suitable when the toner image that is transferred to the material 20 is transferred to a final receptor by the use of pressure. With the arrangements mentioned, high image transfer speeds can be obtained.

The toner image transfer apparatus described in connection with the drawing can also be used in the transfer of a toner image produced at the surface of the layer 12 of the member 10 wherein the layer 12 is a photoconductor and electronically conductive toner powder is used with the process described in U.S. Pat. No. 3,909,258 to Arthur R. Kotz to produce the toner images. As in the example given with respect to using the transfer apparatus for styli printing, the cylindrical member 18 can be used with anodized aluminum providing the material 20 or with an elastomeric silicone rubber (polymer) provided over anodized aluminum. In addition, it is possible to use a coating of a fluorinated polymer, such as polytetrafluoroethylene over aluminum. A gap of about 20 to 100 microns is suitable between the material 20 of member 18 and the layer 12 of member 10. D.C. voltage provided by the d.c. voltage supply 22 in the range of about 400 to 1000 volts can be utilized. Conductive toner as utilized for the styli printing example can be used for imaging. Transfer speeds of 2.5 centimeters per second and higher can be attained with the best results obtained at higher speeds.

The conductivity for toner powder with which the described transfer apparatus is used has been mentioned. The conductivity values determined for toner powder are dependent on the manner in which they are measured and must be related to the conductivity found in relation to a level of the electric field used in the measurement. The conductivity range given earlier is for toner powder measured in accordance with the procedure set forth in U.S. Pat. No. 3,639,245 to Robert B. Nelson at column 3, line 54 to column 4, line 47 and are those obtained for measurements at an applied electric field of 100 volts per cm.

While the member 10 with the layer 12 has been depicted as being cylindrical in shape, it should be appreciated that this combination can also be provided by a flexible continuous belt member for member 10, such as are commonly found in high speed copy or duplicator machines, with the appropriate material for layer 12 carried by the belt member. Similarly, the member 18 can take the form of a flexible continuous belt of conductive material with the dielectric material 20 provided as for member 18 at the outer surface. In such case, the belt is arranged to pass over a roller (not shown) positioned to provide the desired transfer gap with member 12. With the belt passing over a roller, the outer surface of the belt presents a portion of a cylindrical surface at the transfer gap to provide good gap control.

While only a preferred embodiment of the invention has been described, it will be apparent that various modifications may be made therein without departing from the scope of the invention as defined in the appended claims.

I claim:

1. Toner powder image transfer apparatus for transferring images of electronically conductive toner powder from the surface of a layer carried on the outer surface of a first movable, electrically conductive, cylindrical member including:

a second movable, electrically conductive, cylindrical member having a dielectric material at its outer surface for receiving the transferred toner image, said second member positioned from the first member to provide an air space that is at least as great as the extreme dimension of the largest toner powder particles with the first member positioned so the layer carried by the first member is parallel to said outer surface of said second member at said air space, and means for applying a d.c. voltage continuously between said first member and said second member for transferring toner powder from the first member at said air space to said dielectric material at the outer surface of said second member during movement of the first member and said second member.

2. A toner powder image transfer apparatus according to claim 1 wherein said second member is a heated member.

* * * * *